US005375440A

United States Patent [19]

Patterson

[11] Patent Number: 5,375,440

[45] Date of Patent: Dec. 27, 1994

[54] LOCKABLE STORAGE CASE FOR A HANDGUN

[76] Inventor: Scott D. Patterson, 520 E. Angela St., Pleasanton, Calif. 94566

[21] Appl. No.: 108,308

[22] Filed: Aug. 19, 1993

[51] Int. Cl.[5] ..... B65D 55/14

[52] U.S. Cl. ..... 70/63; 70/164; 70/166; 70/203; 206/317; 206/493

[58] Field of Search ..... 70/202, 203, 63, 158, 70/159, 163, 164–166, 170, DIG. 34; 206/317, 493

[56] References Cited

U.S. PATENT DOCUMENTS

| | | | |
|---|---|---|---|
| 1,335,593 | 3/1920 | Moll | 70/203 |
| 1,599,685 | 9/1926 | Spaeth | 70/165 |
| 1,636,641 | 7/1927 | Lewis | 70/165 |
| 3,213,653 | 10/1965 | Probasco | 70/166 |
| 3,369,721 | 2/1968 | Lentz | 206/317 |
| 3,624,945 | 12/1971 | Foote | 70/202 X |
| 4,788,838 | 12/1988 | Cislo | 70/63 |
| 4,799,370 | 1/1989 | Cooper | 70/159 X |
| 4,890,466 | 1/1990 | Cislo | 70/63 |

*Primary Examiner*—Lloyd A. Gall

[57] ABSTRACT

A small and lightweight, and thus hand carried storage case for a handgun is provided in a plastic rectangular container having a lockable lid. The interior chamber of the case is sized and structured for securely retaining a handgun in a stationary position. The interior floor of the storage case has a hollow cylindrical post over which the trigger guard of the handgun must be placed when inserted into the case. An aperture located on the lid aligns with the hollow post, creating a passageway through the case. The passageway is structured for retaining a small lock bolt which is retained in position with a conventional padlock. Once the lid is affixed to the case and secured with the locking apparatus, the gun cannot be removed from the case.

3 Claims, 4 Drawing Sheets

LOCKABLE STORAGE CASE FOR A HANDGUN

BACKGROUND OF THE INVENTION

1. Field of the Invention

This invention relates to portable storage cases for guns, and more specifically to a hand-carried and lockable case structured for preventing unauthorized users from handling and operating a handgun.

2. Description of the Prior Art

With the increasing awareness of the number of accidental shootings, and the resulting increasing number of laws pertaining to the safe securement of firearms, the importance of locking systems to render guns inaccessible and inoperative to unauthorized individuals has grown in recent years. There are prior art devices such as lockable gun safes which render guns inaccessible. There are prior art devices attachable to guns in the trigger guard area, or in the barrel and chamber which render the gun inoperative. Gun safes are typically quite expensive, very heavy and not easily portable. Trigger and chamber locks leave the gun available to be handled, such as by small children, if not additionally stored in a gun safe.

Prior art portable and lockable storage cases structured for holding a single handgun are found taught in U.S. Pat. No. 4,788,838 issued Dec. 6, 1988 to D. M. Cislo, and in U.S. Pat. No. 4,890,466 issued Jan. 2, 1990 also to D. M. Cislo. Both of these prior art cases are capable to storing a handgun within the interior of the lockable case, but both appear quite expensive to manufacture which would translate into being relatively expensive for the consumer to purchase, resulting in many consumers choosing not to purchase the Cislo cases.

There appears to be a need for an inexpensive, small and lightweight, and thus portable gun case which not only prevents a gun from being handled or played-with such as by small children, but also preferably renders the gun generally inoperative to such a degree that the gun won't fire upon dropping or jarring when secured in the case. It is of course always preferred that a gun be stored in a case without a round in the chamber, but some feel they have a quicker response time in acquiring a ready to fire gun for their protection by storing the gun ready to fire. Although the storing of a ready to fire gun is highly recommended against for reasons of safety, there will be those who will do it regardless of all warnings against it. Therefore an ideal handgun storage case would be one which secured the gun in a manner wherein it was very unlikely the gun would discharge upon dropping the case with the properly stored but otherwise ready to fire handgun. This case would ideally be very inexpensive to manufacture, and sufficiently so that it could be utilized as the shipping box within which a handgun would be contained when sold. Since most handguns are currently sold in cardboard boxes, the ideal lockable case would be one which could be manufactured at little or no increase in cost compared to the current in-use cardboard boxes, and thereby every purchaser of a new handgun would hopefully automatically receive this type of high security case from the gun manufacturer when he purchased his handgun, and at little or no price increase compared to the gun in a standard un-lockable cardboard box.

SUMMARY

The present invention provides a lockable, small and lightweight, and thus portable gun case which not only prevents the gun from being handled or played-with such as by small children, but also preferably renders the gun inoperative to such a degree that the gun is extremely unlikely to fire upon dropping or jarring when stored within the case. The present case is preferably manufactured of plastics in order to render the case lightweight and very inexpensive, and is sized to securely retain a single handgun. Although the principles of the present invention might possibly be applied to rifles or multiple handguns in a single case, this disclosure as a whole will address a storage case for holding a single handgun. The present case is useful for properly securing the gun for storage and for transporting the gun such as from home to the shooting range, or for when transporting as checked baggage on a commercial airline. A plastic lid of the case, which is removable but could be hinged, is rimmed on the outer periphery with a U-shaped channel structured for frictional engagement over an upper rim of the bottom box-like case. The thin and somewhat flexible and resilient plastic material of which the lid is manufactured allows it to be easily, repeatedly applied and removed from the case. The case is sized in length, width, height and depth for retaining and stabilizing the particular type of handgun which is intended to be stored within the case, and so normally, but not always, a differently sized and slightly structurally varied case is needed for each different type of handgun.

Extending upward from the surface of the interior floor of the box portion of the case, to approximately the same height as the case sidewalls, is an integrally molded hollow cylindrical post with the exterior sidewall of the post preferably affixed with a short vertical alignment flange. Preferably located adjacent the post and flange, and also extending upward from the interior floor of the case to approximately the same height as the post, is a vertical L-shaped wall shaped to abut the handle and trigger guard of the gun. The post, flange, and vertical L-shaped abutment wall in combination with the case and case lid cooperatively serve to tightly retain the gun within the case and also to render the gun inoperable when the case is locked. The lid of the case prevents the gun from sliding upward and off of the post. The term "inoperative" will henceforth be used in terms of the handgun being very unlikely to discharge upon dropping the case with the properly stored but loaded handgun.

The lid of the case contains an annular opening which is structured in use to be centered over the open interior passage of the post. The edge of the lid opening is also affixed with a U-shaped channel structured for releasable attachment over the upper distal annular rim of the post. Once the lid is affixed in position onto the case, there is a continuous passageway created through the post which extends from the top surface of the lid to the exterior bottom surface of the box portion of the case. The passageway is not in communication with the interior chamber of the storage case, which is in effect sealed against the entrance of dust and water. The passageway is used in conjunction with a locking apparatus to retain the lid onto the case of the storage case.

The locking apparatus includes a small lock bolt generally comprised of a short cylindrical shaft having an enlarged head on the bottom end. The upper end of the shaft contains a transverse aperture sized for passage of the shackle portion of a key or combination lock. The shaft portion of the lock bolt is sized for complete insertion through the entire passageway of the case. The head of the bolt however, engages a reduced diameter portion defined by a beveled ledge on the interior of the passageway adjacent the top edge of the post, which prevents the lock bolt from completely passing through the bore. When the lock bolt is properly placed, the aperture of the lock bolt projects sufficiently above the surface of the lid of the case, when the head abuts the ledge, to be accessible by the padlock. Once the padlock is inserted into the aperture of the lock bolt, the lid of the storage case cannot be removed.

The three previously mentioned structures of the cylindrical post, flange and vertical L-shaped wall effectively function as a positioning guide arrangement which requires the handgun to be stored within the case in only one position. When the gun is properly inserted into the case, the trigger guard of the gun must be inserted over the post and connecting flange. When the handgun is stored and locked in a properly sized case in accordance with the present invention, if the handgun is of the type having an exposed hammer, the gun is maintained in a manner wherein the hammer cannot abut against the interior wall of the case, and thereby if the case with secured gun is dropped, and a round happens to be chambered in the gun, the hammer cannot be impacted and driven against the round to cause it to fire. The barrel end of the gun is also preferably maintained a short distance away of the interior sidewall of the case by the L-shaped wall or other similar integrally molded supports placed to stabilize the gun, and thereby the end of the barrel cannot be impacted upon the dropping of the case. Therefore the particular structure of the interior of the case not only secures the gun tightly, which protects the finish from minor scratches which might occur if the gun were allowed to fall loosely within the case, and the structure also renders the gun inoperable and inaccessible when the lid is affixed and locked. These are important safety measures especially when young children are present. The storage case is therefore a safety device for protecting people, and also a sealed container which protects the gun from dust, moisture and minor abrasions. The storage case is also an ideal container for transporting or shipping the gun. Since the structure and design of the invention is relatively simple, and the materials and method of manufacturing may be automated plastic injection molding, the lockable storage case can be very inexpensively made and marketed.

DESCRIPTION OF THE PREFERRED EMBODIMENT

Figure 1:
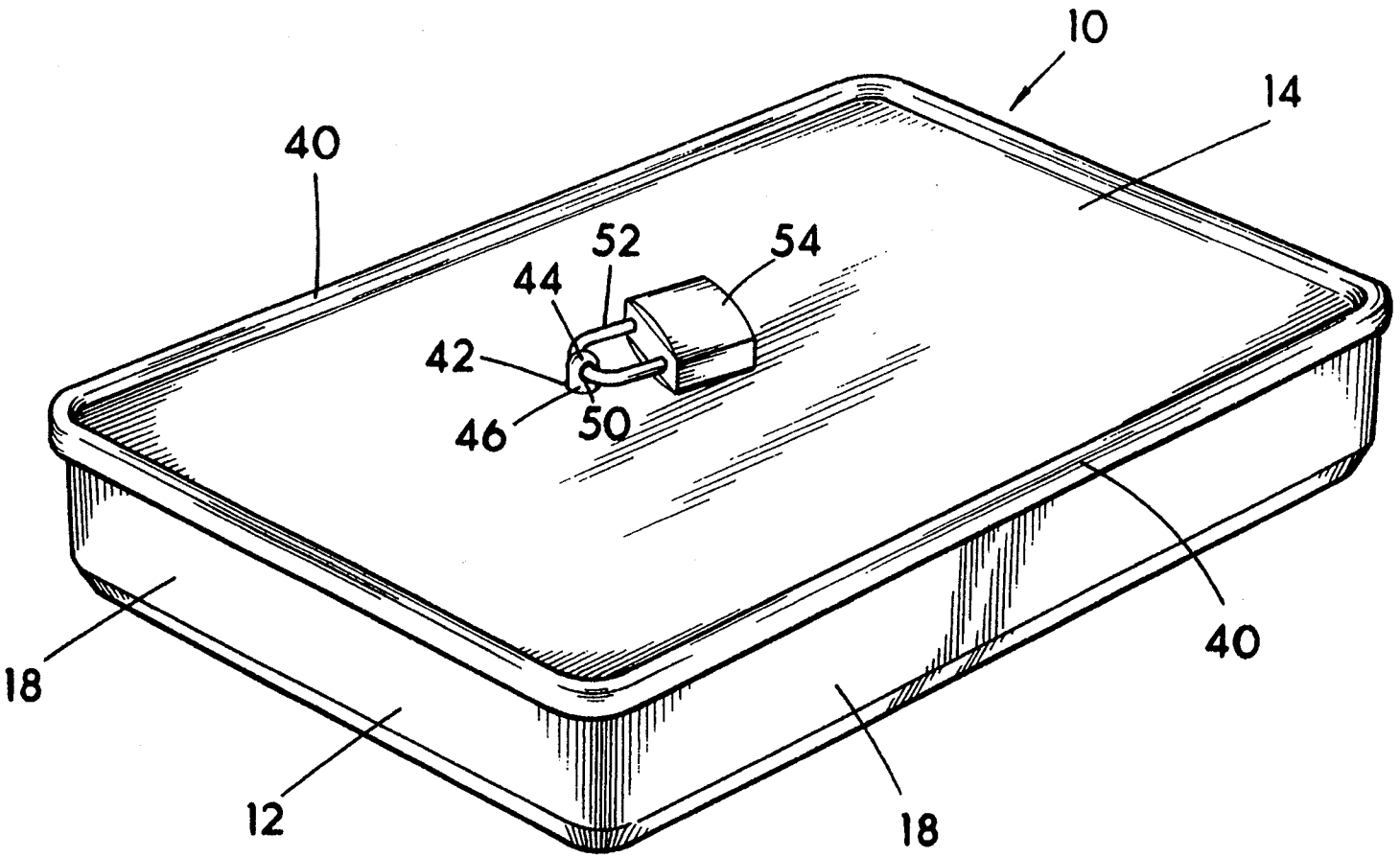
FIG. 1 is a top perspective view of a preferred embodiment of my lockable storage case for a gun.

Referring now to the drawings where a preferred embodiment of my lockable storage case 10 is illustrated as an example. Storage case 10 is basically a rectangular plastic container having a shallow box-like bottom portion designated case 12, and a substantially flat lid 14. Case 12 includes a rectangular flat bottom panel 16 edgewardly affixed with four short sidewalls 18. The sidewalls 18 of this particular embodiment of storage case 10 are shown in the drawings having an outwardly beveled upper rim 20 and inwardly beveled lower edge which is integrally formed with bottom panel 16. The beveled structure of sidewalls 18 helps provide rigidity, but straight non-beveled sidewalls 18 are also acceptable. The interior surfaces of the four sidewalls 18 along with the interior surface of bottom panel 16 define an open interior chamber 22. Interior chamber 22 is sized and structured for retaining a particular make and model of handgun 24, which for the purposes of the disclosure is shown as a .45 automatic pistol in the drawings. However, other embodiments of storage case 10, not shown, are provided for use with other various models of firearms. Those other embodiment of storage case 10 would therefore necessarily be sized and structured to conform to those particular models of handguns 24.

Figure 3:
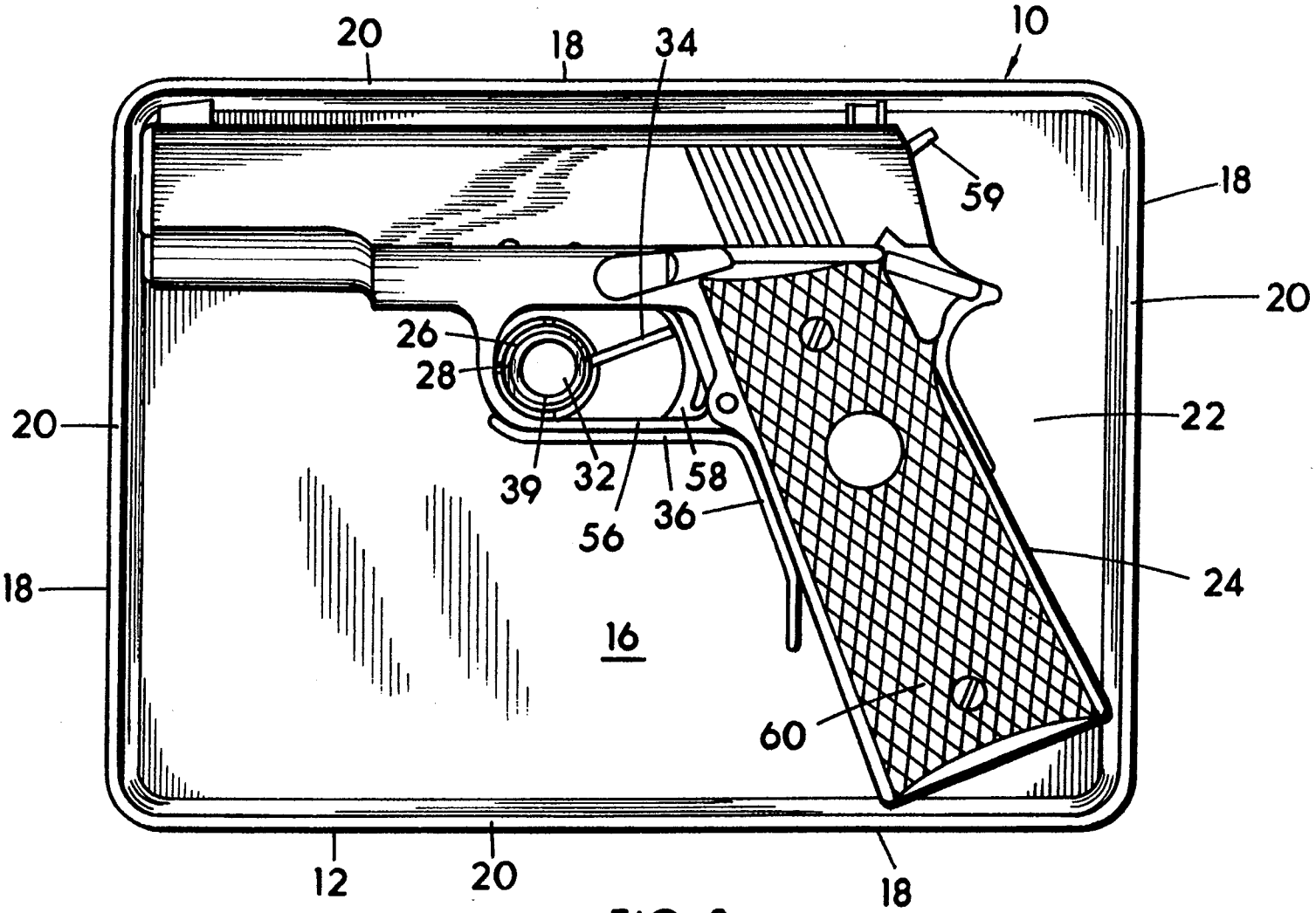
FIG. 3 is a top plan view of the preferred embodiment with the lid removed and containing a properly positioned handgun. The hammer of the gun is shown maintained away from any surface it might possibly abut.
Figure 4:
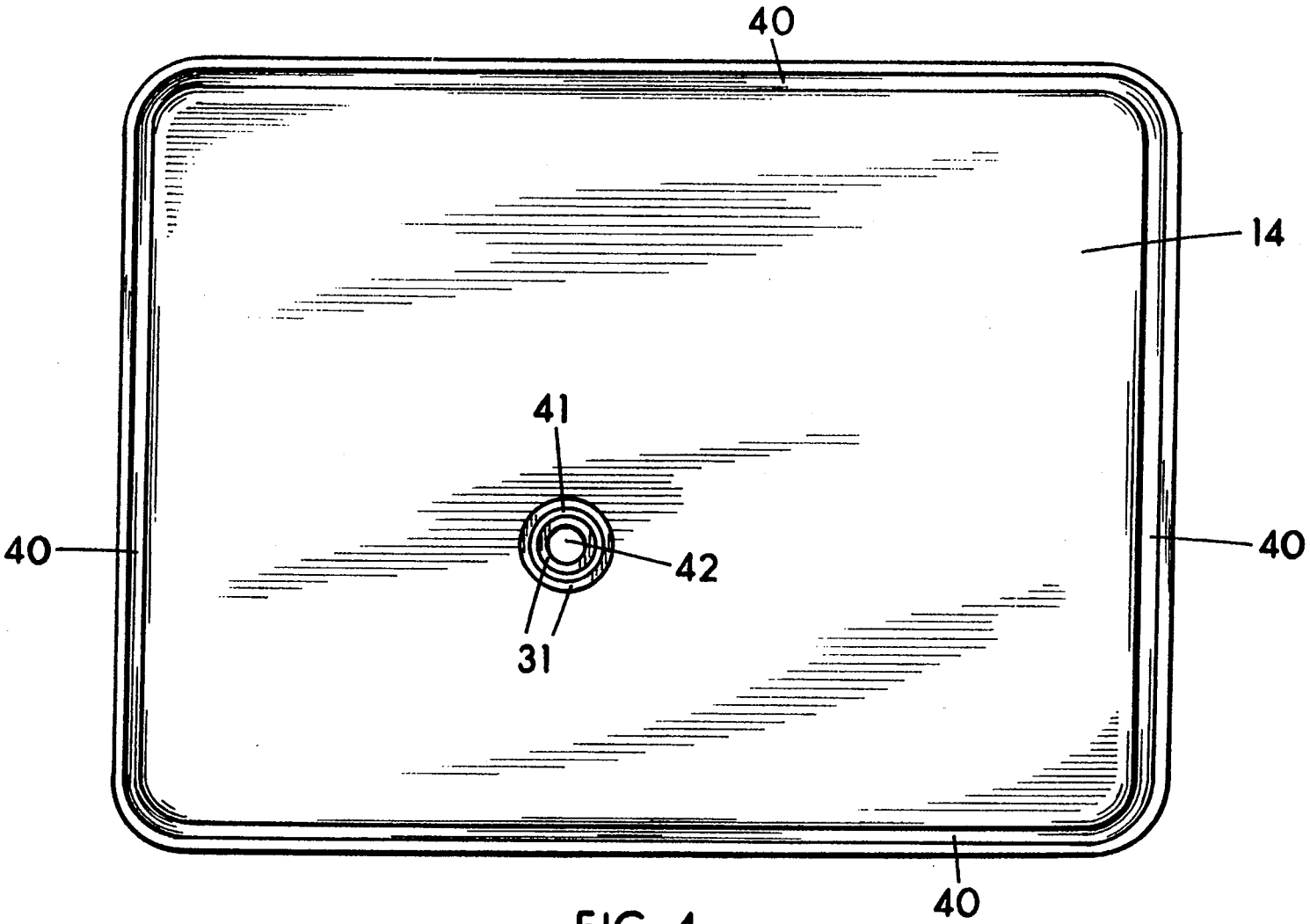
FIG. 4 is a plan view of the underside of the lid showing the opening.

Extending upward from the interior surface of bottom panel 16 is a hollow, substantially cylindrical post 26. The annular wall 28 of post 26 is integrally formed with bottom panel 16, and is roughly located off center of bottom panel 16 towards the upper left hand corner thereof, as shown in FIG. 3. Wall 28 of post 26 bevels inward slightly and terminates on the upper distal end in an open flat annular edge 30. Annular edge 30 of post 26 is positioned in height to just below the level of rim 20 of sidewalls 18. The hollow interior of post 26 is open on both terminal ends and is referred to as lock bolt passage 32. The interior of lock bolt passage 32 has a small flange located adjacent the upper annular edge 30 of post 26, comprised of a lower beveled annular ledge 38 with an upper flat annular ledge 39.

Preferably affixed to the outside surface of the annular wall 28 of post 26 and to bottom panel 16 of case 12, is a short, flat, vertical flange 34 which functions in aligning a gun and in assisting in making sure the gun can be placed in the case in only one position. The vertical flange 34 "may" be sized and positioned to depress the trigger of the gun and maintain it in a depressed state so that the weapon can not be fired. I personally feel that it may be safer if flange 34 was not quite long enough to depress the trigger of the gun, and arguments in favor of both ways could be made.

Figure 2:
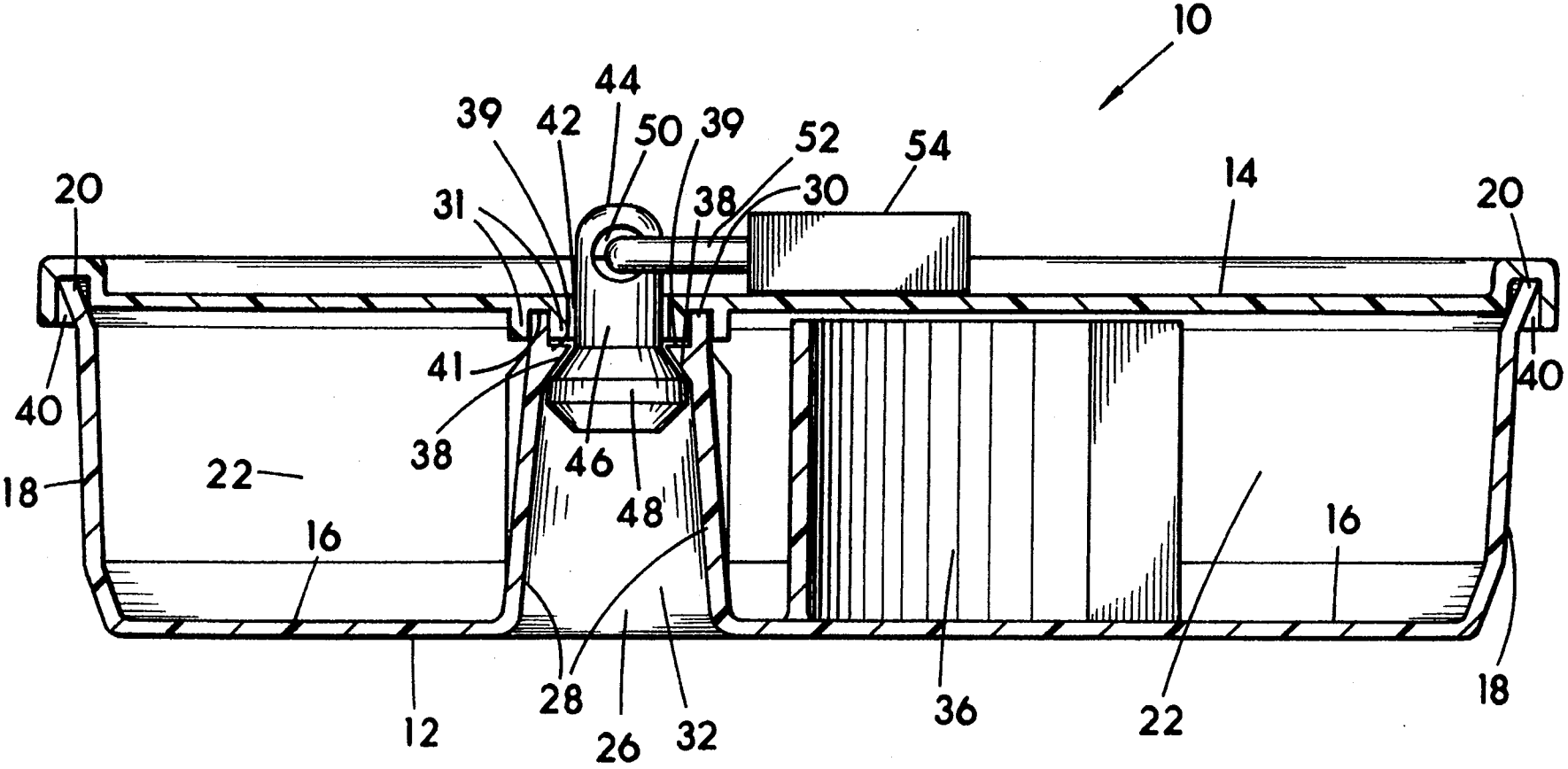
FIG. 2 is cross sectional side view of my preferred embodiment taken through the assembled locked case taken at the location of the post. The lock bolt, not cross sectioned for illustrative purposes, is shown within the passageway of the post and secured in position with a padlock.

Positioned adjacent post 26 on the interior surface of bottom panel 16, is an irregular L-shaped vertical wall 36 approximately the same height as post 26, best shown in FIG. 2 and 3. This L-shaped wall 36 has a horizontal section which is parallel to the longitudinal sidewalls of case 12, and also an angled section, both of which function to assure proper positioning of handgun 24 with case bottom 12. Other abutment walls or posts could be used in lieu of or in addition to L-shaped wall 36.

Lid 14 of storage case 10 is generally flat and rectangular in shape, and is rimmed on the periphery with an integral U-shaped attachment channel 40. The open trough of the U-shaped channel 40 is located on the bottom surface of lid 14, with the upper domed shaped portion thereof extending slightly upward above the top surface of lid 14. The U-shaped channel 40 of lid 14 is structured for releasable placement over the upper rim 20 of sidewall 18 of case 12. The natural resiliency and malleability of lid 14 allows channel 40 to expand and conform to the shape of rim 20, and the two frictionally adhere to one another.

An annular opening 42 is located through lid 14 which is positioned over lock bolt passage 32 when lid 14 is properly affixed to case 12. The edge of opening 42 is also rimmed with an annular recess or channel 41, similar to channel 40 located on the periphery of lid 14. U-shaped channel 41 is defined by two annular downward extending flanges 31 in spaced relationship with one another, concentric with one another, one flange 31 having a larger diameter than the inner flange 31, and channel 41 lies between the two flanges 31. Channel 41 is sized to receive the upper annular edge 30 of post 26. Once lid 14 and case 12 are properly assembled, lock bolt passage 32, which is not in communication with interior chamber 22, essentially extends as an open bore from the top surface of lid 14 to the bottom surface of bottom panel 16 of case 12.

Lock bolt passage 32 is sized for receiving and retaining lock bolt 44, which functions as part of a locking apparatus to secure lid 14 onto case 12. Lock bolt 44 is structured with a short cylindrical shaft 46 having an enlarged beveled cylindrical head 48 formed on one end thereof. Lock bolt 44 can be comprised of either metal or a strong plastic material. The upper end of shaft 46 contains a transverse cylindrical aperture 50 sized for passage of the shackle 52 portion of a padlock 54. The exterior diameter of shaft 46 is sized for passage completely through lock bolt passage 32 and through the central opening of beveled ledge 38. However, the enlarged annular head 48 of lock bolt 44 is significantly larger than shaft 46 and engages the lower beveled surface of ledge 38 and prevents complete passage of lock bolt 44. To affix lock bolt 44 to storage case 10, it is suggested that the user first invert storage case 10 so that the bottom surface is positioned upward, so that gravity will pull shaft 46 of lock bolt 44 down through passage 32 and opening 42. Then the user inserts a finger into lock bolt passage 32 to hold the head 48 of lock bolt 44 against beveled ledge 38 while the user turn storage case 10 over and secures padlock 54 to shaft 46. When lock bolt 44 is inserted, shaft 46 first, through lock bolt passage 32 on the bottom surface of case 12, the top portion of shaft 46 is structured to extend upward beyond the top surface of lid 14 sufficiently to clear aperture 50 for passage of shackle 52, before head 48 engages beveled ledge 38.

To insert handgun 24 into interior chamber 22 of case 12, the inner edge of hand grip 60 of handgun 24 is aligned with the angled arm of L-shaped wall 36, and the lower arm of trigger guard 56 is aligned with the horizontal arm of L-shaped wall 36. Trigger guard 56 is also centered over post 26 and alignment flange 34, and flange 34 is adjacent trigger 58. This is the only position handgun 24 can be inserted into case 12 due to the interior size of the case, the position of post 26 within the case, and the shape of the gun 24 relative to the case and post.

When lid 14 is affixed to case 12 and locked with lock bolt 44 and padlock 54, handgun 24 is rendered inoperable and secured against tampering by children. It should be noted that hammer 59 of gun 24 is shown in FIG. 3 being maintained away from any surface it might possibly abut. Although not illustrated, lock bolt 44 can also be substantially longer in length, with head 48 extending in length from beveled ledge 38 to the exterior surface of bottom panel 16 of case 12. This would eliminate the need of the user to manually retain lock bolt 44 in position as storage case 10 is re-inverted to the upright position since the extended length of head 48 would project the distal end of shaft 46 out of opening 42 when storage case 10 was placed on a flat surface. Actually, lock bolt 44 can be structured in a variety of different forms and still function adequately as a locking apparatus. Various structures could include a vertical flat rod substituted for shaft 46, and a flat annular plate substituted for head 48 for example. I also anticipate a carrying handle might be attached to the exterior of the case. Therefore, as various embodiments and alterations might be made in the invention set forth, it is to be understood that all matters herein described or shown in the accompanying drawings are to be interpreted as illustrative and given for example, and therefore the invention is not to be overly limited by the specification.

What I claim as my invention:

1. A portable storage case for a handgun, comprising: a box-like case bottom having a bottom panel and sidewalls defining an interior chamber sized for holding a handgun, said chamber having an open top, a hollow post within said chamber and attached to and extending from said bottom panel upward toward said open top of said chamber, said hollow post sized for insertion through a trigger guard of the handgun for generally stabilizing the handgun, said hollow post being open through said bottom panel and open at an upper distal end of said hollow post, a lid attachable over said open top of said box-like case bottom for closing said chamber, said lid having an aperture therethrough being aligned with said hollow post to define a bore completely through said storage case when said lid is affixed to said box-like case bottom, means for locking said lid attached on said box-like case bottom for locking a handgun within said storage case, said means for locking including a lock bolt having a shank and an enlarged head with said lock bolt being insertable shank first into said hollow post whereat an end of said shank extends out of said bore beyond said lid, said enlarged head preventing complete passage of said lock bolt through said bore, said end of said shank having a transverse bore sized for accepting a shank of a padlock.

2. A portable storage case for a handgun, comprising: a box-like case bottom having a bottom panel and sidewalls defining an interior chamber sized for holding a handgun, said chamber having an open top, a hollow post within said chamber and attached to and extending from said bottom panel upward toward said open top of said chamber, said hollow post sized for insertion through a trigger guard of the handgun for generally stabilizing the handgun, said hollow post being open through said bottom panel and open at an upper distal end of said hollow post, a lid attachable over said open top of said box-like case bottom for closing said chamber, said lid having an aperture therethrough being aligned with said hollow post to define a bore completely through said storage case when said lid is affixed to said box-like case bottom, means for stabilizing a handgun within said chamber, said means for stabilizing including said chamber having internal dimensions which in combination with the location of said hollow post on said bottom panel render a handgun stable when placed in said chamber with said hollow post through the trigger guard of the handgun, means for locking said lid attached on said box-like case bottom for locking a handgun within said storage case, said means for locking including a lock bolt having a shank and an enlarged head with said lock bolt being insertable shank first into said hollow post whereat an end of said shank extends out of said bore beyond said lid, said enlarged head preventing complete passage of said lock bolt through said bore, said end of said shank having a transverse bore sized for accepting a shank of a padlock.

3. A portable storage case for a handgun, comprising:

a box-like case bottom having a bottom panel and sidewalls defining an interior chamber sized for holding a handgun, said chamber having an open top, a hollow post within said chamber and attached to and extending from said bottom panel upward toward said open top of said chamber, said hollow post sized for insertion through a trigger guard of the handgun for generally stabilizing the handgun, said hollow post being open through said bottom panel and open at an upper distal end of said hollow post, at least one location within said hollow post having a substantially reduced diameter portion, a lid attachable over said open top of said box-like case bottom for closing said chamber, said lid having an aperture therethrough being aligned with said hollow post to define a bore completely through said storage case when said lid is affixed to said box-like case bottom, means for stabilizing a handgun within said chamber, said means for stabilizing including said chamber having internal dimensions which in combination with the location of said hollow post on said bottom panel render a handgun stable when placed in said chamber with said hollow post through the trigger guard of the handgun, means for locking said lid attached on said box-like case bottom for locking a handgun within said storage case, said means for locking including a lock bolt having a shank and an enlarged head with said lock bolt being insertable shank first into said hollow post whereat an end of said shank extends out of said bore beyond said lid, said enlarged head being prevented from passing completely through said bore by said reduced diameter portion, said end of said shank having a transverse bore sized for accepting a shank of a padlock.

* * * * *